US008616640B2

(12) United States Patent
van Hekken

(10) Patent No.: US 8,616,640 B2
(45) Date of Patent: Dec. 31, 2013

(54) CHAIR

(75) Inventor: Hendrik R. van Hekken, Allentown, PA (US)

(73) Assignee: Knoll, Inc., East Greenville, PA (US)

( * ) Notice: Subject to any disclaimer, the term of this patent is extended or adjusted under 35 U.S.C. 154(b) by 275 days.

(21) Appl. No.: 13/106,973

(22) Filed: May 13, 2011

(65) Prior Publication Data

US 2011/0285191 A1 Nov. 24, 2011

Related U.S. Application Data

(60) Provisional application No. 61/346,545, filed on May 20, 2010.

(51) Int. Cl.
*A47C 1/024* (2006.01)

(52) U.S. Cl.
USPC ..... 297/300.1; 297/299; 297/325; 297/326

(58) Field of Classification Search
USPC ..... 297/299, 300.1, 325, 326
See application file for complete search history.

(56) References Cited

U.S. PATENT DOCUMENTS

| | | | | |
|---|---|---|---|---|
| D176,813 | S | 1/1956 | Parker | |
| 3,272,555 | A | 9/1966 | Barecki et al. | |
| 3,297,360 | A * | 1/1967 | Holmstrom | 297/302.1 |
| 4,380,352 | A | 4/1983 | Diffrient | |
| 4,533,177 | A | 8/1985 | Latone | |
| 4,536,031 | A | 8/1985 | Latone | |
| 4,786,106 | A * | 11/1988 | Bottemiller | 297/265.1 |
| 4,796,950 | A * | 1/1989 | Mrotz et al. | 297/303.3 |
| 4,869,552 | A | 9/1989 | Tolleson et al. | |
| 5,004,259 | A * | 4/1991 | Ayers et al. | 280/304.1 |
| 5,039,163 | A | 8/1991 | Tolleson | |
| 5,154,438 | A | 10/1992 | Barclay | |
| D361,674 | S | 8/1995 | Carter, Sr. | |
| 5,599,064 | A * | 2/1997 | Vanderminden, Sr. | 297/344.21 |
| 5,601,337 | A | 2/1997 | Choda et al. | |
| 5,683,139 | A | 11/1997 | Golynsky et al. | |
| 5,904,397 | A | 5/1999 | Fismen | |
| 5,909,923 | A | 6/1999 | DeKraker | |
| 5,944,382 | A | 8/1999 | Ambasz | |
| 6,386,634 | B1 | 5/2002 | Stumpf et al. | |
| 6,595,584 | B1 * | 7/2003 | Caldwell | 297/258.1 |
| 6,669,292 | B2 | 12/2003 | Koepke et al. | |
| 6,767,066 | B1 | 7/2004 | Tornero | |

(Continued)

FOREIGN PATENT DOCUMENTS

WO 2008041868 4/2008

*Primary Examiner* — Philip Gabler
(74) *Attorney, Agent, or Firm* — Buchanan Ingersoll & Rooney PC

(57) ABSTRACT

A chair includes a base that has a generally U-shaped member. The generally U-shaped member is comprised of a front member attached to a first end portion and a second end portion. A seat is supported on the base and is moveable from an upright position to a reclined position. A first resilient member is attached to the first end portion of the generally U-shaped member. A second resilient is attached to the second end portion of the generally U-shaped member. End portions of the first and second resilient members are attached to the seat adjacent to a rear portion of the seat. The first and second resilient members are sized and configured to resiliently move or flex such that the seat is positioned at the reclined position when a user sits on the seat.

20 Claims, 11 Drawing Sheets

(56) References Cited

U.S. PATENT DOCUMENTS

| | | | | |
|---|---|---|---|---|
| 6,817,667 | B2 | 11/2004 | Pennington et al. | |
| 6,869,142 | B2 | 3/2005 | Heidmann et al. | |
| 6,896,327 | B1 * | 5/2005 | Barile, Sr. | 297/297 |
| 6,910,736 | B2 | 6/2005 | White | |
| 6,913,315 | B2 | 7/2005 | Ball et al. | |
| 7,273,253 | B2 | 9/2007 | Deimen et al. | |
| 7,841,660 | B2 * | 11/2010 | Wang et al. | 297/260.1 |
| 2004/0189073 | A1 | 9/2004 | Chadwick et al. | |
| 2005/0052061 | A1 | 3/2005 | Deimen et al. | |
| 2005/0093354 | A1 | 5/2005 | Ball et al. | |
| 2007/0000111 | A1 | 1/2007 | Johnson et al. | |
| 2009/0289482 | A1 * | 11/2009 | Fukai | 297/300.1 |

* cited by examiner

22

CHAIR

CROSS REFERENCE TO RELATED APPLICATION

The present application claims priority to U.S. Provisional Patent Application Ser. No. 61/346,545, which was filed on May 20, 2010. The entirety of U.S. Provisional Patent Application Ser. No. 61/346,545 is incorporated by reference herein.

FIELD OF INVENTION

The present invention relates to chairs.

BACKGROUND OF THE INVENTION

Chairs may include different bases to support a seated user in different seated positioned. U.S. Pat. Nos. D176,813, D361,674, U.S. Pat. Nos. 3,272,555, 4,380,352, 4,536,031, 4,533,177, 4,869,552, 5,039,163, 5,154,438, 5,601,337, 5,683,139, 5,904,397 5,909,923, 5,944,382, 6,386,634, 6,669,292, 6,767,066, 6,817,667, 6,869,142, 6,910,736, 6,913,315, and 7,273,253, U.S. Patent Application Publication Nos. US 2007/0000111, 2005/0093354, 2005/0052061 and 2004/0189073 and World Intellectual Property Publication No. WO 2008/041868 disclose chairs that utilize different types of chair bases.

Many chairs include a chair base that supports movement of the seat or back of the chair to a reclined position. In some chairs, only a chair back will recline and the seat will stay substantially horizontal. In other designs, both the seat and back may move synchronously. Often, such chair bases utilize complex designs that include torsion springs, leaf springs or coil springs for supporting or controlling such recline movement. Such designs are often relatively expensive to manufacture.

A new chair base configuration is desired that can permit a relatively low cost chair base to provide a comfortable recline action of the seat or the back of a chair. Preferably, the new chair base provides a simple design that permits low cost manufacturing of the chair.

SUMMARY OF THE INVENTION

A chair is provided that includes a base, a seat supported on the base, and a plurality of resilient members. The base includes a generally U-shaped member that is attached to at least one leg. The seat is moveable from an upright position to a reclined position. The seat is at a greater degree of declination when in the reclined position relative to when the seat is in the upright position. A first end of a first resilient member is attached to the first end portion of the generally U-shaped member. A first end of a second resilient member is attached to the second end portion of the generally U-shaped member. The second end of the first resilient member and the second end of the second resilient member are attached to the seat adjacent to a rear portion of the seat. The first and second resilient members are sized and configured to resiliently move or flex such that the seat is positioned at the reclined position when a user sits on the seat.

The generally U-shaped member may be a unitary structure. The generally U-shaped member may be a tubular member or may have tubular end portions. The generally U-shaped member may include corner portions that attach a front member to the first and second end portions. For instance, a first corner portion may attach the first end portion to a first side of the front member and a second corner portion may attach the second end portion to a second side of the front member. The second side of the front member is opposite the first side of the front member.

Preferably, the first and second resilient members are pultrusion springs. The resilient members may be composed of a polymeric material, metal, or a composite material. The first and second resilient members may each be elongated and have a circular, elliptical, rectangular, hexagonal, or polygonal cross section.

The chair may include a back. The back may be attached to the seat, the base, or both the seat and the base. In some embodiments, the back is integral with the seat. For instance, the seat and back may be portions of a unitary shell that defines the seat and back. The seat and back may each be composed of a polymeric material. In some embodiments, the seat and back may be upholstered or covered with a pad and fabric to provide a desired seating comfort level. The back may be attached to the seat, base or both the seat and base so that when the seat is moved to the reclined position, the back is moved to a reclined position and when the seat is moved to the upright position the back is also moved to the upright position.

The seat may be a portion of a seating structure. For example, the seat may be supported by a seat frame or may be attached to a frame member.

The one or more legs of the base may be only one leg, such as a pedestal, or may be a plurality of legs. For instance, the one leg may be a pedestal that includes a gas spring and is attached to a castored bottom portion. As another example, the one or more legs may include four legs that are each attached to a particular part of the seat or base. For example, the one or more legs may include two front legs and two rear legs. The rear legs may be attached to the front legs and the front legs may be attached to the front member of the generally U-shaped member via a support member.

In some embodiments of the chair, the second ends of the first and second resilient members may be attached to the seat via fastening mechanisms. For example, a first fastening mechanism may retain a portion of a second end of the first resilient member and attach the second end of the first resilient member to the seat. A second fastening mechanism may retain a portion of a second end of the second resilient member and attach that second end of the second resilient member to the seta. The first and second fastening members may be tubular portions, tubular members, brackets, or other connector devices. Preferably, the first and second fastening members are attached to a bottom side or bottom surface of the seat.

Other details, objects, and advantages of the invention will become apparent as the following description of certain present preferred embodiments thereof and certain present preferred methods of practicing the same proceeds.

BRIEF DESCRIPTION OF THE FIGURES

Present preferred embodiments of furniture, such as chairs and present preferred methods of furniture component attachment are shown in the accompanying drawings.

DETAILED DESCRIPTION OF PRESENT PREFERRED EMBODIMENTS

Figure 1:
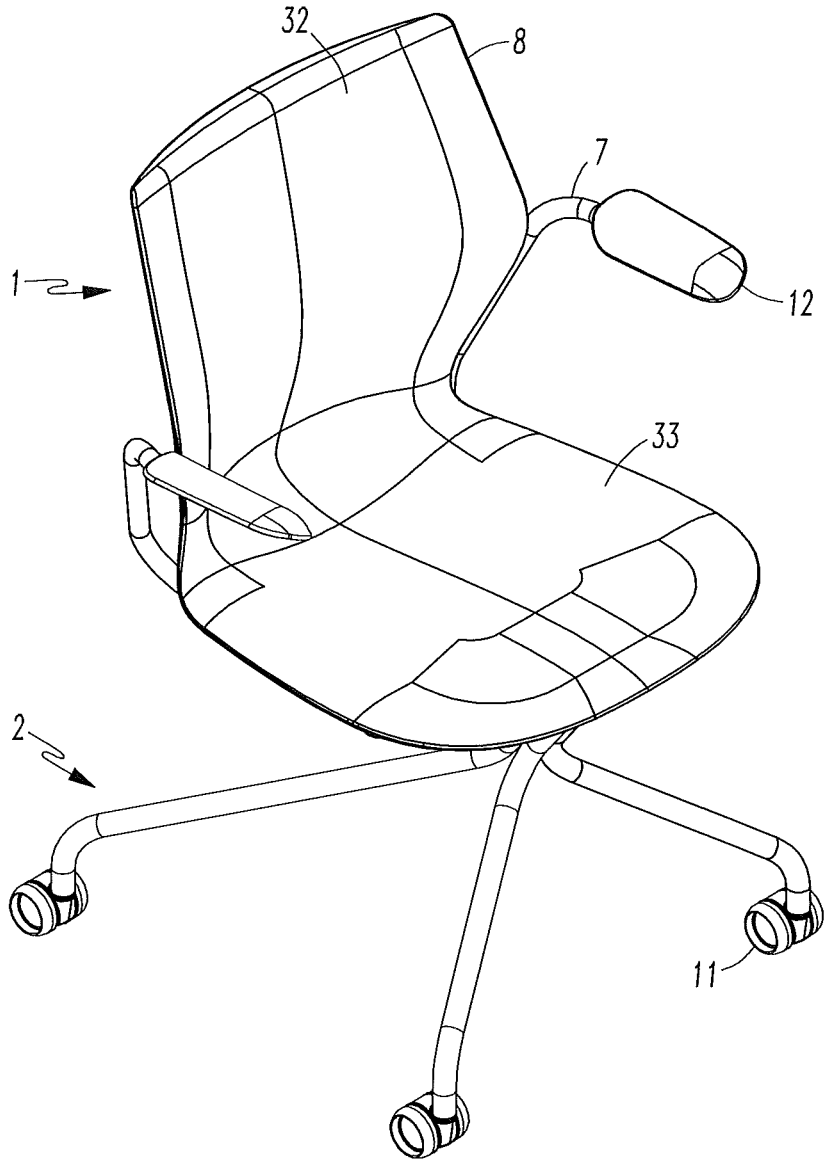
FIG. 1 is a perspective view of a first present preferred embodiment of a chair.
Figure 2:
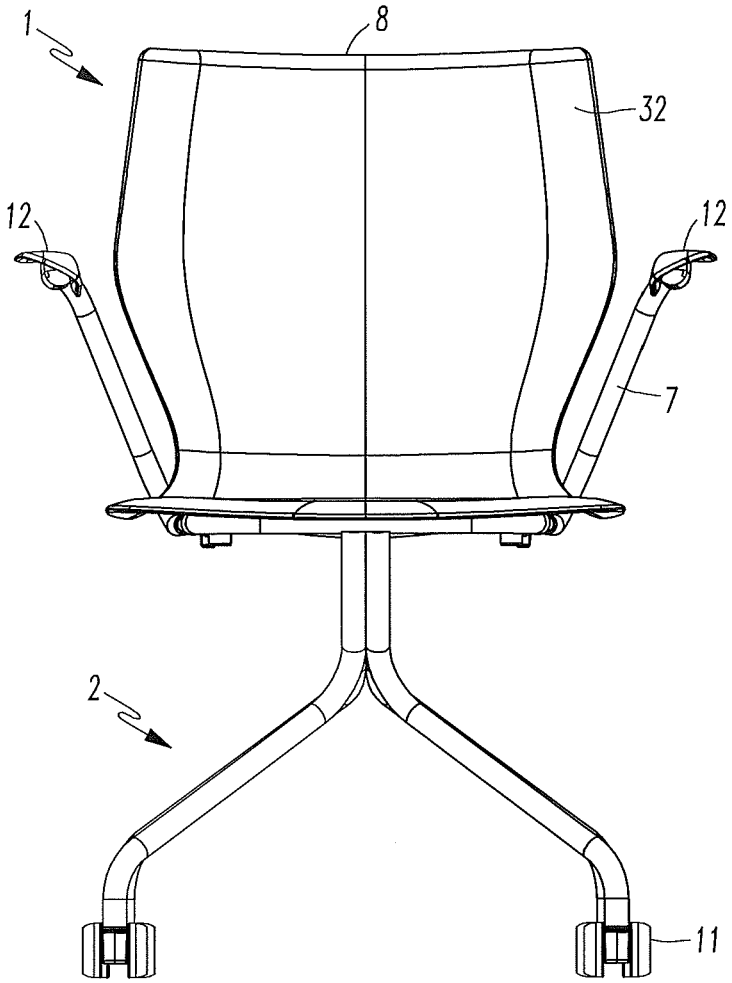
FIG. 2 is a front view of the first present preferred embodiment of a chair.
Figure 3:
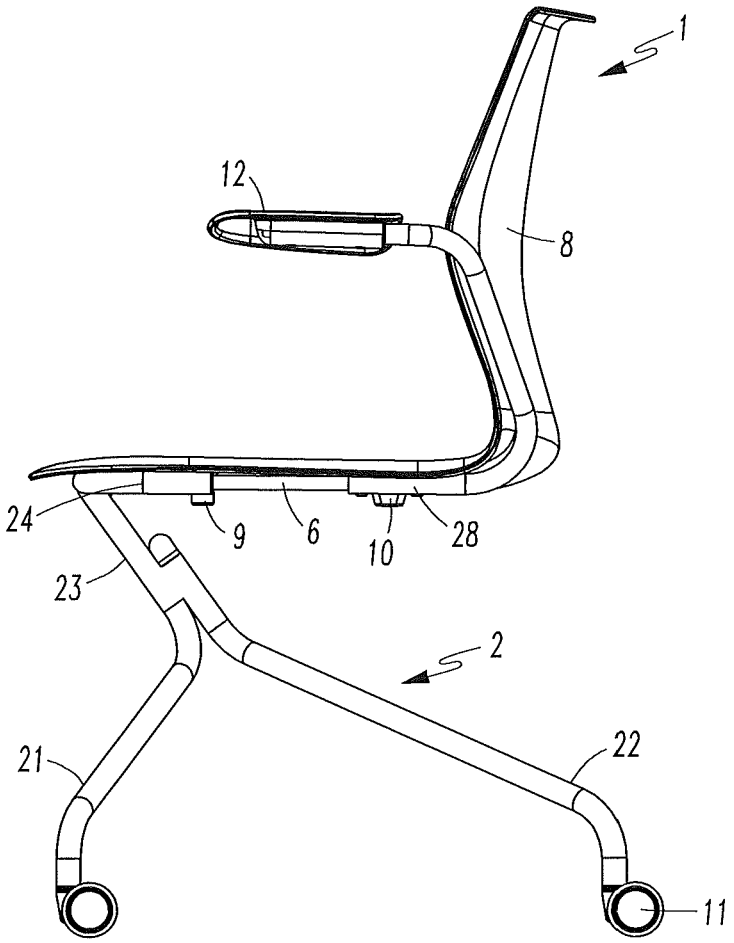
FIG. 3 is a side view of the first present preferred embodiment of a chair.
Figure 4:
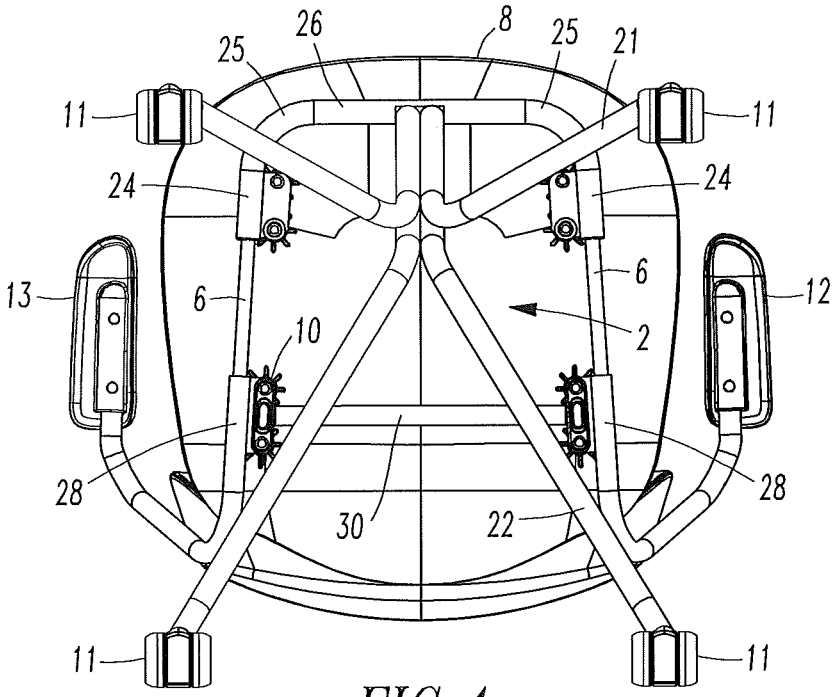
FIG. 4 is a bottom view of the first present preferred embodiment of a chair.

Referring to FIGS. 1-8, a chair 1 may include a base 2 that supports a seating structure 8. The seating structure 8 may be a unitary structure that defines both a back 32 and a seat 33. The seating structure 8 is preferably composed of a polymeric material, such as a thermoplastic nylon with 13% glass. As another example, the seating structure 8 could be composed of a thermoplastic polyester elastomer, a polybutylene terephtalate (PBT) or Hytrel material.

Fabric or cushions may be attached to the seating structure 8 to provide a soft support to a seated user. For example, one or more fabric pads may be positioned on the seat 33 and back 32 portions of the seating structure 8 to provide a soft support for a seat user. A lumbar support could also be attached to the back 32 to provide additional support to a seated user.

Figure 6:
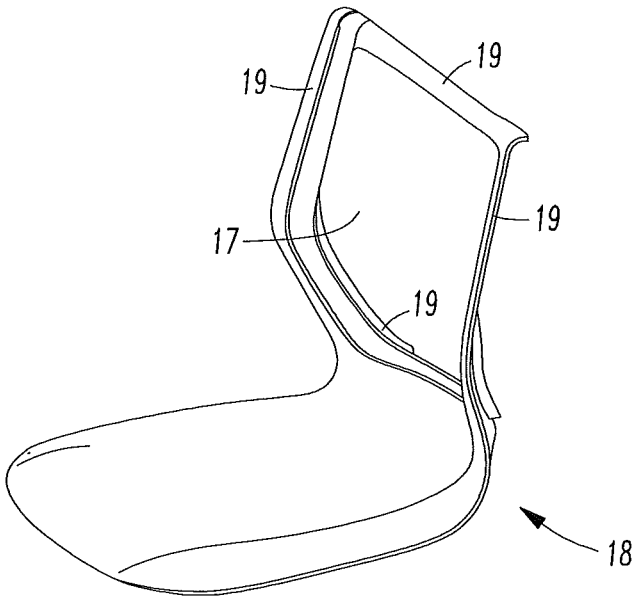
FIG. 6 is a perspective view of a present preferred seating structure that is sized and configured to be a one piece shell for providing a chair seat integrally attached to a chair back.
Figure 5:
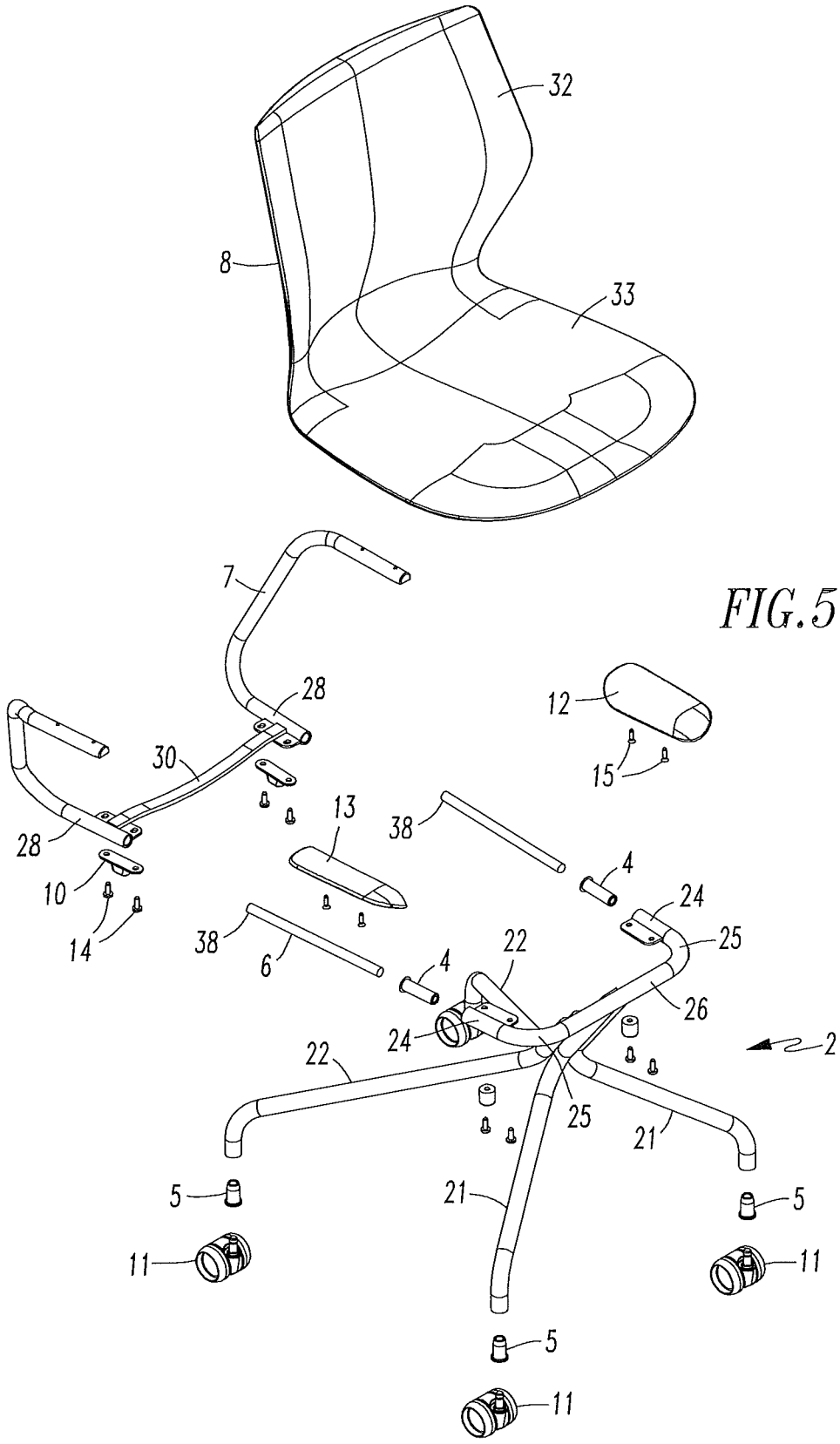
FIG. 5 is an exploded view of the first present preferred embodiment of a chair.

Referring to FIG. 6, a seating structure 18 may alternatively have one or more openings for skin elements. For instance, the seating structure 18 may include an opening 17 sized to receive a back skin element. The back skin element may be a back skin member that is relatively soft. The back skin member may have a mesh configuration or may be a sheet of polymeric material. The sheet may have holes formed therein or may be solid. As an alternative, the back skin may be composed of fabric or woven material. The seating structure 18 may include sidewalls 19 that are configured to receive edge portions of the skin element for attaching the skin element to the seating structure 18. It should be appreciated that the sidewalls 19 may function as a back frame for the back skin.

It is also contemplated that the seat 33 portion of the seating structure 8 may include an opening for receiving a skin element. The skin element may include a fabric or polymeric sheet material or may include a mesh material. As yet another alternative, a seating structure may only include an opening for a seat skin element and not include an opening for a back skin element. For such embodiments, the back may be defined by a portion of the seating structure.

It is also contemplated that the seat 33 may include a seat frame. A bottom surface of the seat frame may be attached to the base 2 to attach the seat 33 of the seating structure 8 to the base 2. It is also contemplated the seating structure may not include an integral back 32. Instead, the back 32 may be a separate component attached to the seat 33, the base 2 or both the base 2 and the seat.

The base 2 of the chair 1 may include one or more legs that are attached to castors 11. Alternatively, the legs may merely have an end configured to engage the ground or a floor. Preferably, the base 2 is sized and configured to provide a cantilevered arrangement. Front legs 21 may be attached to a support member 23. Rear legs 22 may also be attached to the support member 23. The rear legs 22 may be welded to the support member or may be integral to the support member 23. The front legs 21 may be integral with the support member or may be welded to the support member 23. Of course, the front legs 21 and rear legs 22 may be attached to the support member 23 via other alternative fastening mechanisms as well, such as bolts, screws or other fasteners or fastening devices.

In alternative embodiments, the base may only include one leg. For instance, the base may be attached to a leg affixed to the floor of a room or the leg may be a gas spring or other member that is attached to a bottom frame that includes castors or wheels. The leg may be positioned below the center of the seat 33 or may be positioned below a center front portion of the seat 33.

The support member 23 is attached to a front U-shaped member or generally U-shaped member that includes end portions 24. The end portions 24 may include flanges 27 for attachment to the bottom of the seating structure 8. The flanges 27 may have holes for receiving bolts, screws or other fasteners to attach the end portions 24 to the seating structure 8. Alternatively, brackets or other fastening mechanisms may be attached to the end portions 24 and configured to receive fasteners for attaching the end portions 24 to the bottom of the seating structure 8.

The U-shaped member may be integral with the support member 23, welded to the support member 23, or may be otherwise attached to the support member 23. Preferably, the legs, support member and U-shaped member are all composed of metal, such as aluminum, steel, or stainless steel. Of course, it is also contemplated that these components may be composed of other materials, such as polymeric material, wood, or other material.

The end portions 24 of the U-shaped member are preferably tubular and each end portion 24 includes an inner channel or aperture sized to receive an end of a pultrusion spring 6. Preferably, the pultrusion spring is a rod. Alternative embodiments may utilize a generally U-shaped member that has a rectangular or polygonal shaped aperture and a pultrusion spring 6 that is shaped to fit within that opening. For instance, the pultrusion spring 6 may alternatively be shaped as a rectangular structure or an elongated member that has a polygonal cross-sectional profile, such as a square or hexagonal shaped cross-section. The pultrusion springs are resilient and flexible. Preferably, the pultrusion springs 6 are composed of vinylester resin with a fiber loading of 76% by weight and 59% by volume and is sized and configured such that each resilient member 47 has a flexural modulus of $6.0\times10^6$ psi, a barcol hardness value of 50, is nine inches long and is a half inch in diameter.

Of course, different embodiments of the chair may include pultrusion springs that have different strength and flexibility properties or different compositions as well. For instance, it is contemplated that the pultrusion springs may be composed of other materials, such as for example, spring steel, isophthalic polyester resin, or other material that provides the pultrusion spring with flexibility and resiliency. The pultrusion springs would preferably have a tensile strength of 100,000 pounds per square inch (psi), a flexural modulus of $6.0\times10^6$ psi and has a notched Izod impact of 40 foot pounds per inch (ft-lbs/in). Of course, other pultrusion springs having different strengths, flexural modulus properties or other material properties may alternatively be used to meet a particular design objective.

The end portions 24 of the U-shaped member may each have a bushing 4 positioned between an end of the pultrusion spring 6 and the end portion 24 to help ensure the end of the pultrusion spring 6 has a tight interference fit within the opening of the end portion 24. For instance, the bushing may be positioned within the opening in the end portion 24 between an end of the pultrusion spring 6 and the end portion 24 to engage the pultrusion spring 6 and create a desired interference fit. The bushing is preferably composed of a resilient material, such as a resilient polymeric material. The bushing may also provide protection for the pultrusion spring by reducing wear experienced by the pultrusion spring that may occur within end portion 24.

The legs, support member 23 and U-shaped member of the base may be arranged such that the base 2 provides a cantilevered support for the seating structure 8 or the seat 33. The cantilevered support may provide support at a front portion of the seat 33 that is positioned at a height that is taller than the support provided at a rearward portion of the seat 33 such that the seat is in a declined position when in an upright position. In alternative embodiments, the seat 33 may be supported such that the seat is horizontal or in a position that is inclined or slightly inclined when in an upright position.

The pultrusion springs 6 may extend from the end portions 24 of the U-shaped member 23 to rear portions of the seating structure 8. The rear ends 38 of the pultrusion spring 6 may be attached to the bottom of the seat 33 portion of the seating structure 8 via a fastening mechanism. For instance, screws or bolts may extend through a rear end of each pultrusion spring 6 to attach the rear ends 38 to the seating structure 8. As another alternative, a frame structure 7 may be attached to the seating structure and include tubular portions 28 that have openings sized to receive and retain the rear ends 38 of the pultrusion springs 6. Preferably, the tubular portions 28 are part of a frame 7 that includes supports for holding armrest pads 12 and 13. The armrest pads 12 and 13 may be attached to armrest frame uprights via fasteners 15 or other fastening mechanisms.

The tubular portions 28 of the frame 7 may also include a cross member 30 that extends between the tubular members 28 of the frame. The cross member 30 may provide additional support to the tubular members 28 and may also provide support to the back portion 32 of the seating structure 8.

Figure 9:
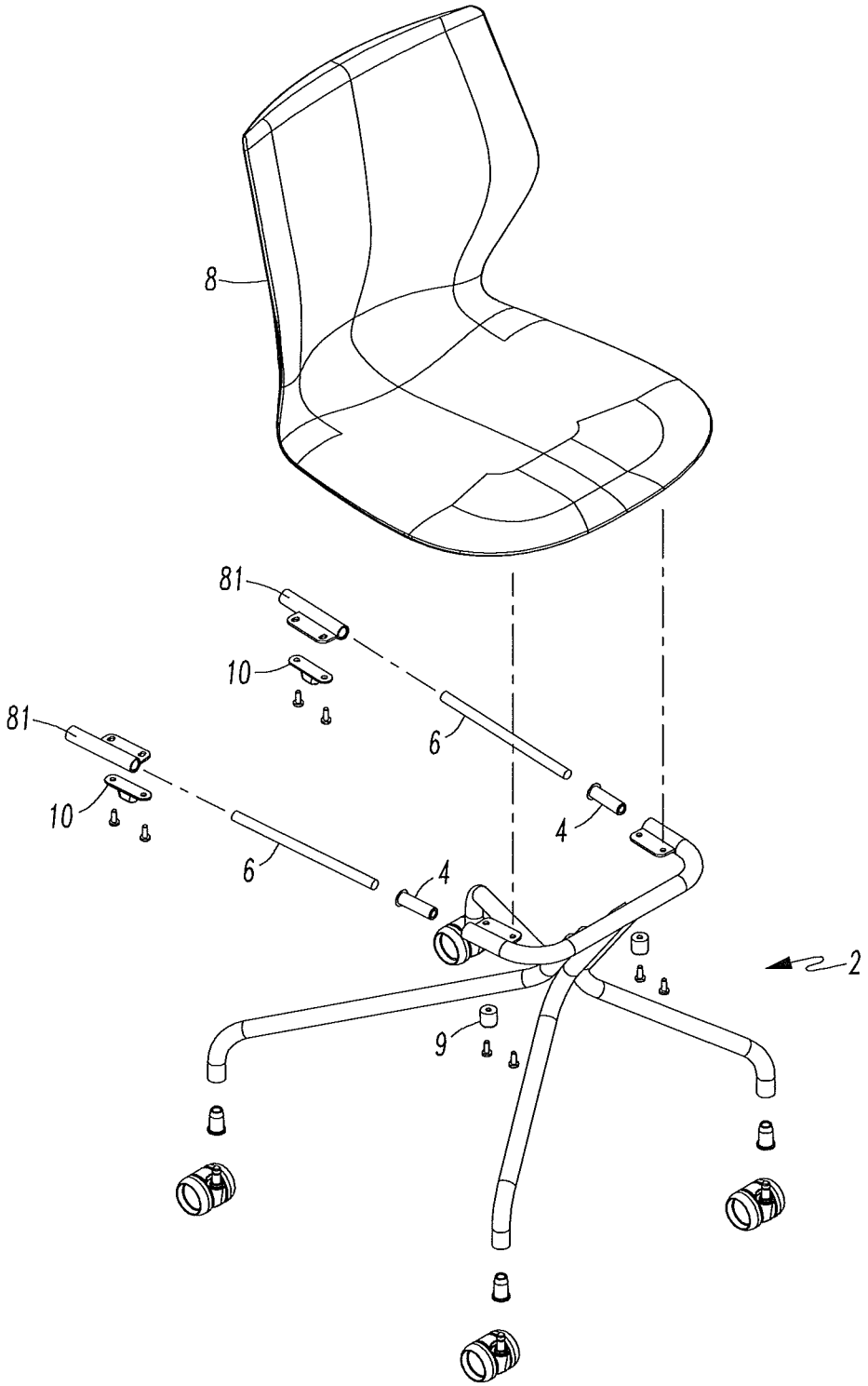
FIG. 9 is an exploded view of a second present preferred embodiment of a chair, which does not include armrests. It should be understood that same reference numbers are used to identify elements that are common to the first embodiment of the chair and the second embodiment of the chair.

In alternative embodiments, the tubular portions 28 and the cross member 30 may be portions of a frame element that does not include armrest frame support components. For example, embodiments of the chair that do not include armrests may not include armrest frame components such as armrest supports for supporting or holding arm pads, as may be appreciated from FIG. 9. Instead of tubular portions 28 of a frame structure 7 configured to support armrests, a chair may include frame structure 81 attached to the bottom of the seat or bottom of a seat frame. Each frame structure 81 may have a channel or opening sized to receive a rear end of a respective pultrusion spring 6 to hold or support the rear ends 38 of the pultrusion springs 6. Bushings may also be provided in a portion of the channels in the frame structure 81 to provide an interference fit between the rear ends 38 of the pultrusion springs 6 and the frame structures 81.

The frame structure 81 may have various different sizes, shapes and structures. For instance, each frame structure 81 may include a flanged tube or flanged pipe that is fastened to the bottom of a seat or bottom of a seat frame via fasteners such as bolts or screws. The fasteners used to attach the frame structure 81 may alternatively include bolts or screws that extend into and attach to brass inserts positioned within portions of the bottom of the seat or bottom of the seat frame. The brass inserts may be sonic welded to the seat frame or seat.

The chair 1 may also include bumpers 10. The bumpers 10 may be affixed to the rear portion of the seating structure 8 and may be positioned adjacent to the rear ends 7 of the pultrusion springs 6. Fasteners 14, an adhesive, or other fastening mechanism may attach the bumpers 10 to the seat structure 8. Alternatively, the seat structure may be molded to include bumpers 10 such that the bumpers 10 are integrally attached to the bottom of the seating structure 8. The bumpers may be composed of a polymeric material such as an elastomeric material and may be positioned adjacent to the pultrusion springs to provide support to the frame elements retaining the rear ends 7 of the pultrusion spring. The bumpers 10 may also be sized and configured to act as plug springs to provide support to the rear end portions of the pultrusion springs 6.

Elastomeric bumpers 9 may also be provided adjacent to corner portions 25 of the generally U-shaped member. The corner portions 25 may be between the end portions 24 and a front member 26 of the generally U-shaped member. The bumpers 9 may be composed of an elastomeric material, such as Hytrel material, or a polymeric material and may be positioned to engage the corner portions 25 of the generally U-shaped member. Such bumpers may act as plug springs and provide resilient support to the generally U-shaped member when the base 2 supports the load of a seated user or the load of a seated user pushing against the backrest 32 portion of the chair to recline the chair.

Figure 7A:
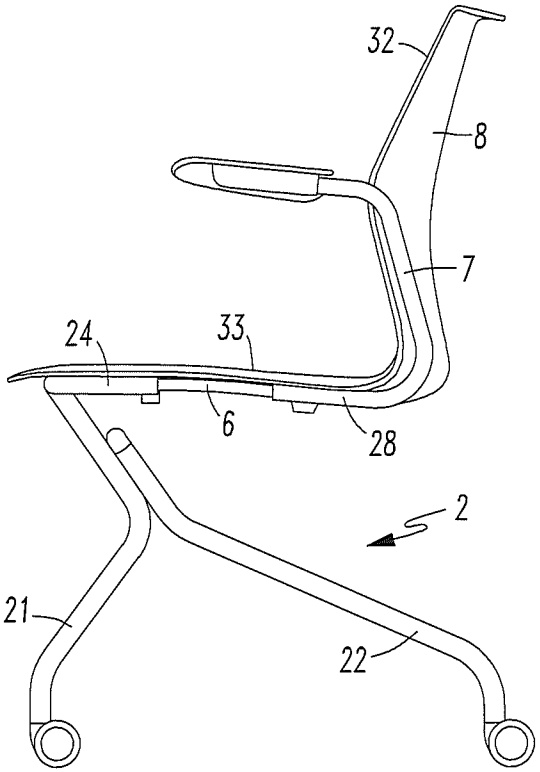
FIG. 7A is an enlarged side view of the first present preferred embodiment of a chair in a reclined position.
Figure 7:
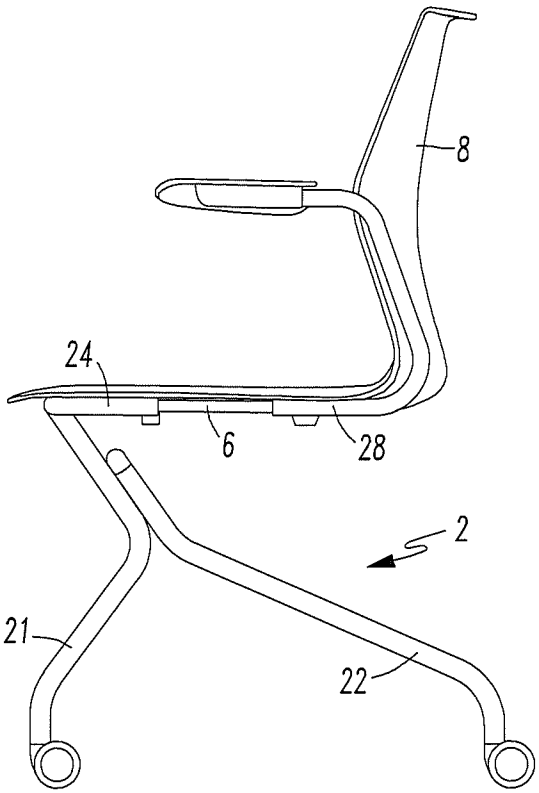
FIG. 7 is an enlarged side view of the first present preferred embodiment of a chair in an upright position.
Figure 8:
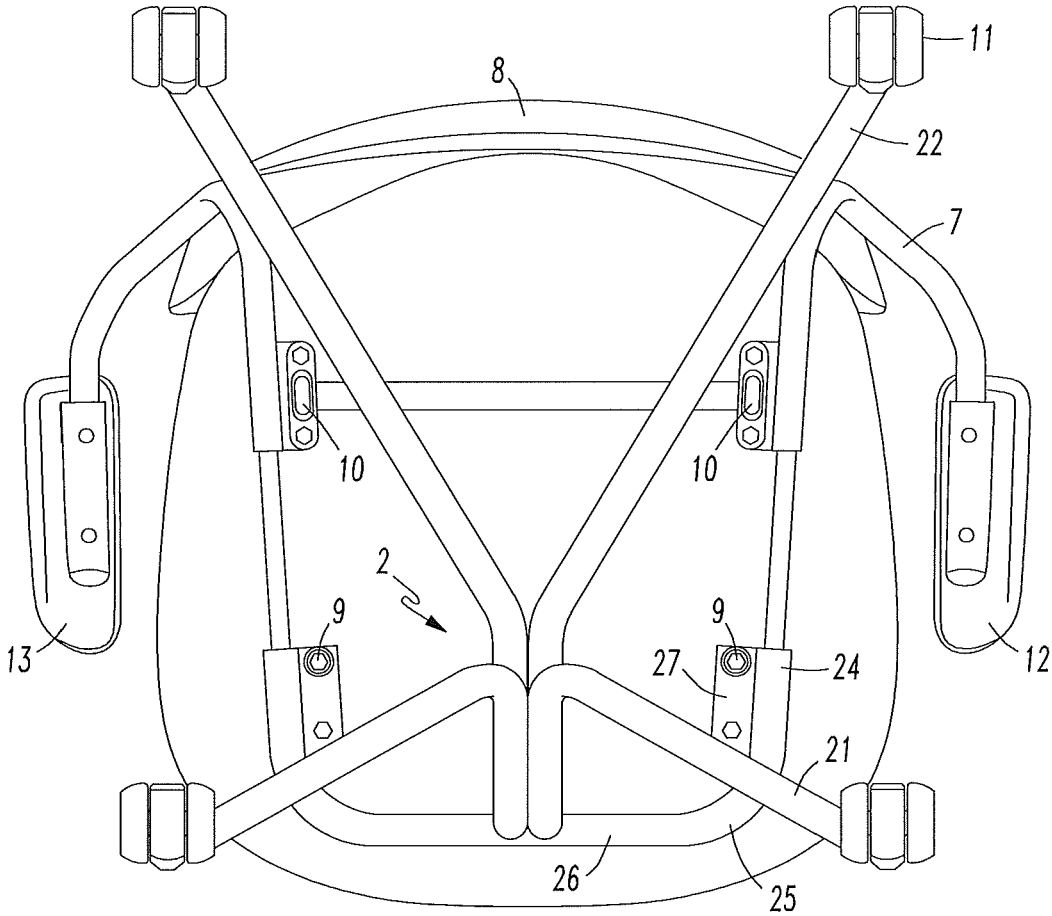
FIG. 8 is an enlarged bottom view of the first present preferred embodiment of a chair.

As may be appreciated from FIGS. 7 and 7A, the pultrusion springs 6 are configured to resiliently move or flex under the load of a seated user so that the seat 33 of the seating structure is positioned in a reclined position. The pultrusion springs 6 may alternatively be configured so that they resiliently move and flexibly bend under the load of a seated user so that the seat 33 of the seating structure is positioned in a reclined position. The reclined position may be a position in which the seat 33 has a greater angle of declination or a greater degree of declination than when the seat is in an upright position. For instance, the seat may be configured to be horizontal or substantially horizontal with a slight degree of declination in the upright position and may be configured to be in a position of greater declination when a seated user sits in the seat 33 portion of the seating structure 8.

It should be appreciated that the use of the pultrusion springs 6 permit the declination of the seating structure 8 during recline to cause less stress to be experienced by the U-shaped member portion of the base 2. The reduction in stress permits a greater amount of recline to occur in some designs. The reduction in stress may also permit designs for cantilevered chair bases, such as base 2, to utilize less material or material that has a lower cost so that embodiments of chairs may be made much simpler and for a lower cost. Further, the life of the chair base 2 and the chair 1 may be extended due to the reduction in stress experienced by the generally U-shaped member that is provided by the pultrusion springs 6.

Figure 10:
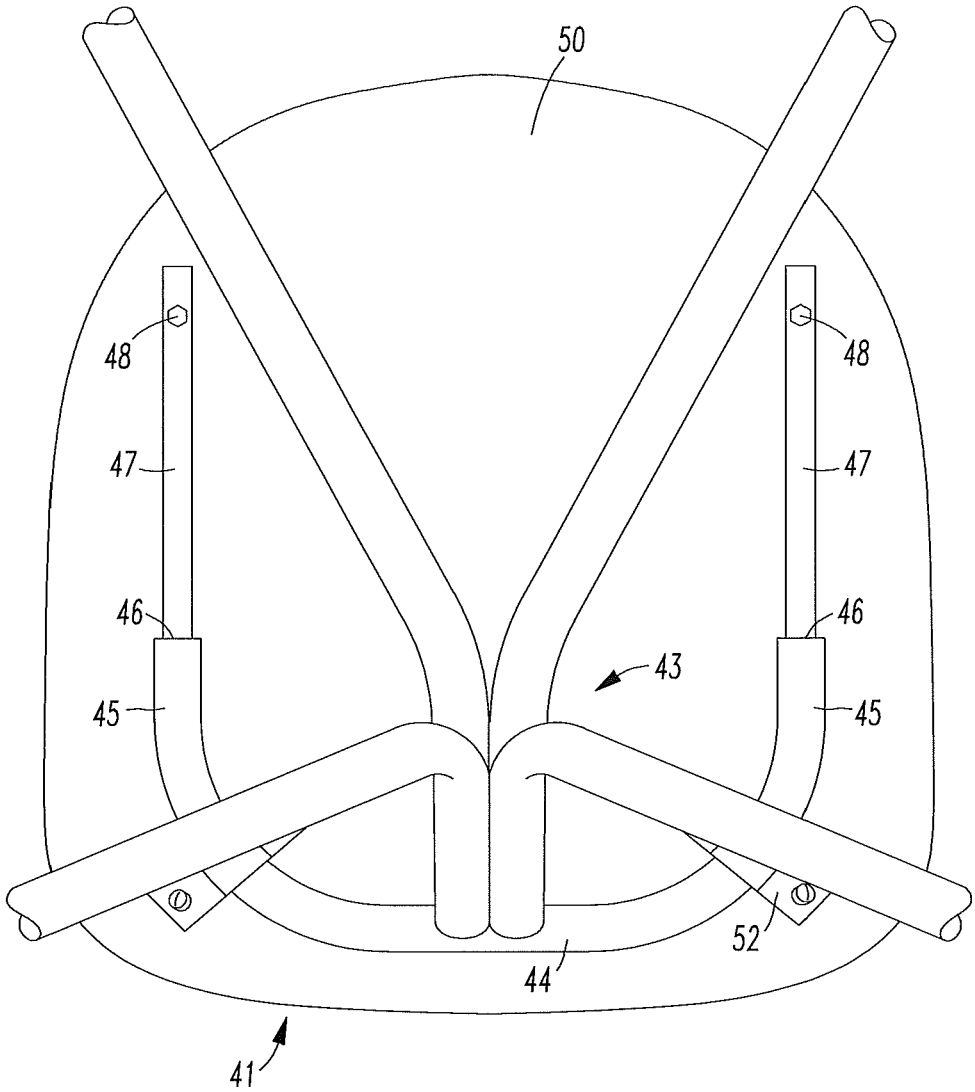
FIG. 10 is an enlarged bottom view of a third present preferred embodiment of a chair.

Referring to FIG. 10, another embodiment of a chair 41 includes a base 43 that has a generally U-shaped member 44 that includes end portions 45. The end portions are attached to retention devices 46 that are positioned within openings formed in the end portions 45. Each retention device 46 is sized and configured to receive a front end portion of a resilient member 47. The resilient member may be a pultrusion spring, or other resilient member.

Preferably, each resilient member 47 is a pultrusion spring composed of vinylester resin with a fiber loading of 76% by weight and 59% by volume and is sized and configured such that each resilient member 47 has a flexural modulus of 6,000,000 psi, a barcol hardness value of 50, is nine inches long and is a half inch in diameter, has a tensile strength of 100,000 psi and has a notched Izod impact of 40 foot pounds per inch. It should be appreciated that the resilient members may have different strengths, flexibility properties or other material properties to meet a particular design objective.

Of course, the resilient members may be other types of members, such as spring steel members or cylindrical or elongated polygonal members composed of isophthalic polyester resin. The resilient members may have different shapes or sizes such as rod-like or bar-like structure or elongated member that have a generally circular cross section or a generally polygonal cross section.

A rear end portion of each resilient member 47 is attached to the bottom 50 of a seat by a fastener mechanism 48. The fastener mechanisms 48 may include screws and nuts, bolts and nuts, or other fastener mechanisms. As another example, the fastener mechanism 48 may alternatively include brackets or flanged portions of frame elements that are positioned near brass inserts sonically welded within bosses or openings formed in the bottom 50 of the seat or seat frame. The brass inserts may include threaded openings for receiving bolts extended through portions of the brackets or flanges for attaching the rear end portion of each resilient member 47 to the bottom 50 of the seat.

The generally U-shaped member 44 may be attached to the bottom 50 of the seat via brackets 52 or via sonic welding or other fastening mechanisms. For example, inserts and bosses may be positioned for attaching the generally U-shaped member to the bottom 50 of the seat. The brackets or other fastening mechanism may be below the U-shaped member and fastened to the seat of the chair 41 to attach the U-shaped member 44 to the seat of the chair.

Figure 11:
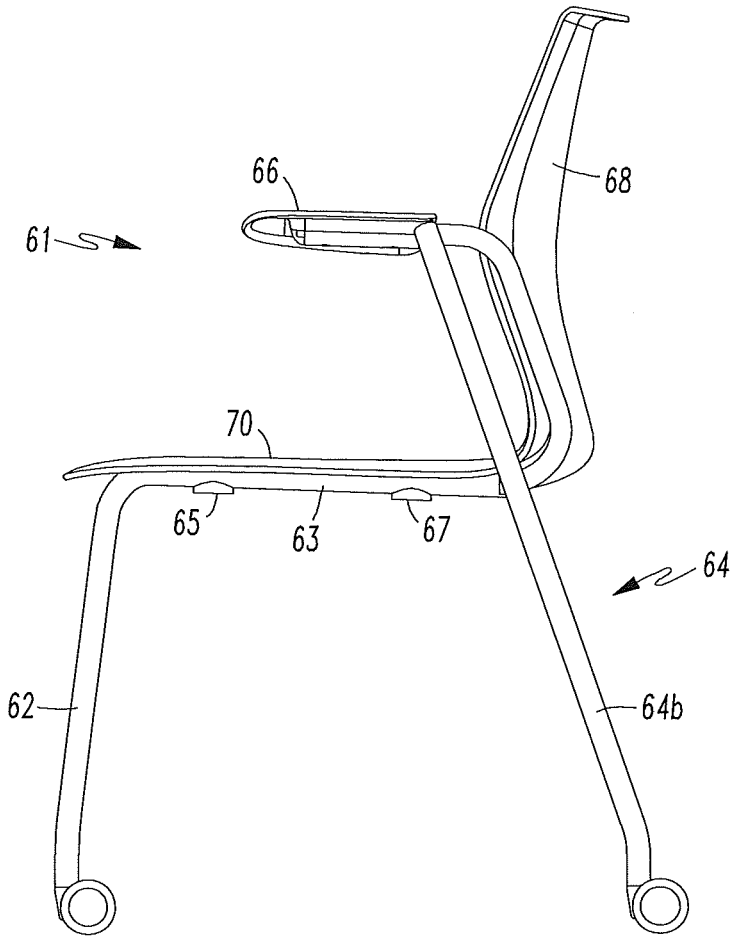
FIG. 11 is a side view of a fourth present preferred embodiment of a chair.

Referring to FIG. 11, a chair 61 may include a chair base 62 that includes a plurality of front legs 62 and a plurality of rear legs 64*b*. The rear legs 64*b* may extend above a seat 70 to support armrests 66. A back 68 may be attached the seat 70. The back may include a mesh back that is composed of a sheet of polymeric material, such as Hytrel material or another elastomeric material.

A pultrusion spring 63 or other resilient member may be attached between a front leg 62 and a bottom rear portion of a chair. A front end of each pultrusion spring 63 may be attached to an upper tubular portion of a front leg 62. A fastening device 65 may extend through a portion of the front end of the pultrusion spring 63 or the front end may be retained within an opening formed in a portion of the front leg 62. The rear end of each pultrusion spring may not be attached to the rear legs 64*b* to permit the pultrusion springs to flex, bend or resiliently move independent of the rear legs 64*b*. The rear end of each pultrusion spring 63 may be attached to a bottom rear portion of the seat 70. For instance, a bracket or other fastening mechanism may attach a rear end portion of each resilient member 63.

A cross member 64*a* may extend between the rear legs 64*b* to provide support to the rear legs and also support the back 68 of the chair 61. The front legs 62 and rear legs 64*b* may be sized and configured to hold and support the seat 70 such that the cross member 64*a* may also provide an axis about which the backrest may recline when a user exerts a force against the backrest 68.

Figure 12:
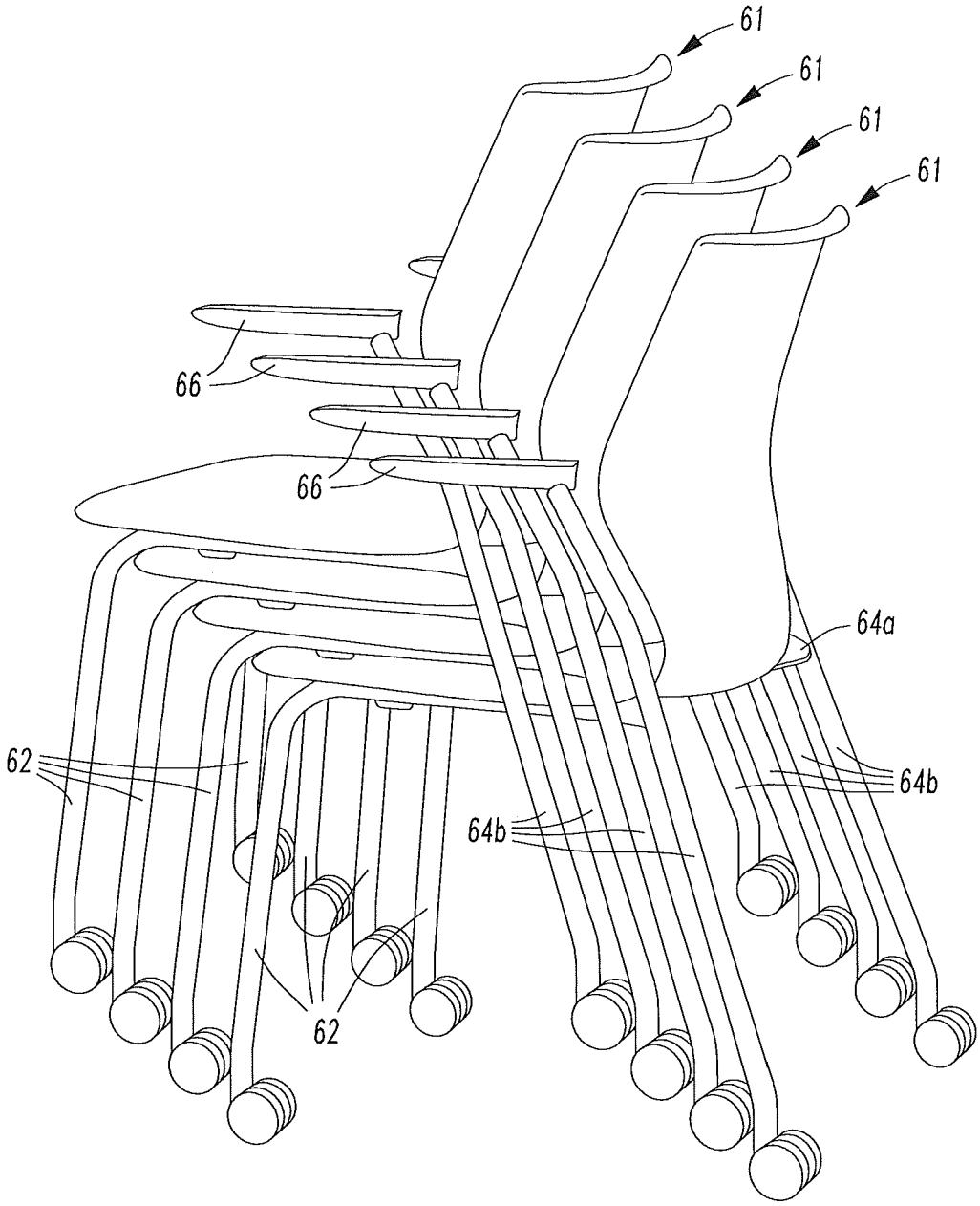
FIG. 12 is a perspective view of a stack of present preferred chairs.

As may be appreciated from FIG. 12, the front legs 62 and rear legs 64*b* may be positioned such that a plurality of chairs 61 may be stacked on top of each other. The chairs may be stacked so that each chair in the stack is supported by the seat of a lower chair.

While certain present preferred chairs and methods of making chairs have been discussed and illustrated herein, it is to be distinctly understood that the invention is not limited thereto but may be otherwise variously embodied and practiced within the scope of the following claims.

What is claimed is:

1. A chair comprising:

a base comprising a first support member, at least one leg and a generally U-shaped member, the generally U-shaped member being a tubular U-shaped structure having a front, a first end portion that extends rearwardly from the front and a second end portion that extends rearwardly from the front, the first end portion being curved and the second end portion being curved, the front of the U-shaped member being attached to an upper end of the first support member, the first support member extending downwardly and rearwardly from the front of the U-shaped member, a lower end of the first support member being attached to the at least one leg;

a seat supported on the base, the first support member attached between the front of the U-shaped member and the at least one leg to provide a cantilevered support to the seat such that support at a front portion of the seat is at a height that is taller than support to the seat that is provided at a rear portion of the seat when the seat is in an upright position, the front of the U-shaped member being positioned adjacent the front of the seat, the seat moveable from the upright position to a reclined position, the seat being at a greater degree of declination when in the reclined position relative to the upright position;

a first resilient member having a first end and a second end, the first end of the first resilient member received within and attached to the first end portion of the generally U-shaped member, the first resilient member having a shape of a rod;

a second resilient member having a first end and a second end, the first end of the second resilient member received within and attached to the second end portion of the generally U-shaped member, the second resilient member having a shape of a rod;

a first tubular portion attached to a bottom of the seat adjacent the rear portion of the seat;

a second tubular portion attached to a bottom of the seat adjacent the rear portion of the seat;

the second end of the first resilient member received within the first tubular portion to attach the second end of the first resilient member to the seat adjacent to the rear portion of the seat; and the second end of the second resilient member received within the second tubular portion to attach the second end of the second resilient member to the seat adjacent to the rear portion of the seat; and the first resilient member and the second resilient member sized and configured to resiliently move or flex such that the seat is positioned at the reclined position when a user sits on the seat.

2. The chair of claim 1 wherein the generally U-shaped member is a unitary structure.

3. The chair of claim 1 further comprising a first plug spring attached to the seat adjacent to the first end portion to engage with the first end portion to provide support to the first end portion when the seat is moved to the reclined position, a second plug spring attached to the seat adjacent to the second end portion to engage with the second end portion to provide support to the second end portion when the seat is moved to the reclined position, a third plug spring attached to the seat adjacent the first tubular portion to support the first tubular portion, and a fourth plug spring attached to the seat adjacent the second tubular portion to support the second tubular portion.

4. The chair of claim 1 wherein the first resilient member is an elongated pultrusion spring and the second resilient member is an elongated pultrusion spring.

5. The chair of claim 1 further comprising a back attached to at least one of the seat and the base.

6. The chair of claim 5 wherein the seat and the back are portions of a unitary seating structure composed of polymeric material.

7. The chair of claim 1 further comprising a back attached to at least one of the seat and the base such that the back is moved to a reclined position when the seat is moved to the reclined position of the seat and the back is moved to an upright position when the seat is moved to the upright position of the seat.

8. The chair of claim 1 further comprising a seating structure, the seat being a portion of the seating structure.

9. The chair of claim 1 wherein the at least one leg is comprised of a pair of front legs and a pair of rear legs, the rear legs attached to the front legs and the front legs attached to the generally U-shaped member via the first support.

10. The chair of claim 1 wherein the at least one leg is comprised of a plurality of legs, each of the legs having a first end and a second end, the first support member attached the first end of the legs and the second end of each of the legs is attached to a wheel or castor.

11. The chair of claim 10 wherein the first support member extends downwardly and rearwardly from the front member linearly at an angle relative to perfectly vertical to provide the cantilevered support to the seat.

12. The chair of claim 1 wherein the first resilient member is elongated and has a circular, elliptical, rectangular, hexagonal, or polygonal cross section and the second resilient member is elongated and has a circular, elliptical, rectangular, hexagonal, or polygonal cross section.

13. The chair of claim 1 wherein the at least one leg is comprised of a pair of front legs and a pair of rear legs, the rear legs directly attached to the front legs and the front legs attached to the generally U-shaped member via direct attachment to the first support member.

14. A chair comprising a seat having a bottom surface and a top surface opposite the bottom surface;

a base attached below the seat, the base comprising a front base member directly attached to a first base member and a second base member, the front base member directly attached to the bottom surface of the seat adjacent a front of the seat, the first base member attached to the bottom surface of the seat, the first base member having an opening, the second base member attached to the bottom surface of the seat, the second base member having an opening;

a first resilient member having a front end and a rear end, the front end of the first resilient member attached within the opening of the first base member;

a second resilient member having a front end and a rear end, the front end of the second resilient member attached within the opening of the second base member; and a first tubular portion directly attached to the bottom surface of the seat adjacent a rear portion of the seat;

a second tubular portion directly attached to the bottom surface of the seat adjacent the rear portion of the seat;

the rear end of the first resilient member received within and attached to the first tubular portion and the rear end of the second resilient member positioned within and attached to the second tubular portion such that the first resilient member and the second resilient member resiliently move or flex such that the seat is positioned at a reclined position when a user sits on the seat.

15. The chair of claim 14 wherein the first base member and the second base member are end portions of a generally U-shaped member and the base is further comprised of a support member and a plurality of legs, the support member attached between the front base member and the legs.

16. The chair of claim 15 wherein the support member is attached between the front base member and the legs such that the base provides a cantilevered support to the seat such that support at a front portion of the seat is at a height that is taller than support to the seat that is provided at a rear portion of the seat when the seat is in an upright position.

17. The chair of claim 16 wherein fastening mechanism directly attaches the support member to at least one of the legs to attach the legs to the support member.

18. The chair of claim 17 wherein the first resilient member is a pultrusion spring and the second resilient member is a pultrusion spring.

19. The chair of claim 14 further comprising a first plug spring attached to the seat adjacent to the first base member to provide support to the first base member when the seat is moved to the reclined position and a second plug spring attached to the seat adjacent to the second base member to provide support to the second base member when the seat is moved to the reclined position.

20. A chair comprising:

a base comprising at least one leg and a generally U-shaped member, the generally U-shaped member attached to the at least one leg, the generally U-shaped member comprised of a front member attached to a first tubular end portion and a second tubular end portion;

the base also comprising a support member attached between the generally U-shaped member and the at least one leg, the support member extending downwardly and rearwardly from adjacent a front of the generally U-shaped member to the at least one leg to provide a cantilevered support to a seat such that a front portion of the seat is supported at a location that is higher than a location at which a rear portion of the seat is supported when the seat is in an upright position;

the seat being supported on the base and being moveable from the upright position to a reclined position, the seat being at a greater degree of declination when in the reclined position relative to the upright position;

a first resilient member having a first end and a second end, the first end of the first resilient member attached to the first tubular end portion of the generally U-shaped member such that a portion of the first end of the first resilient member is positioned in the first tubular end portion of the generally U-shaped member;

a second resilient member having a first end and a second end, the first end of the second resilient member attached to the second tubular end portion of the generally U-shaped member such that a portion of the first end of the second resilient member is positioned in the second tubular end portion of the generally U-shaped member;

a first fastening mechanism attached to the seat, the second end of the first resilient member attached to the first fastening mechanism adjacent to the rear portion of the seat, a portion of the second end of the first resilient member being retained in a portion of the first fastening mechanism;

a second fastening mechanism attached to the seat, the second fastening mechanism being spaced apart from the first fastening mechanism, the second end of the second resilient member attached to the second fastening mechanism adjacent to the rear portion of the seat, a portion of the second end of the second resilient member being retained in a portion of the second fastening mechanism;

a first plug spring attached to the seat adjacent to the first end tubular portion to engage with the first tubular end portion to provide support to the first tubular end portion when the seat is moved to the reclined position;

a second plug spring attached to the seat adjacent to the second tubular end portion to engage with the second tubular end portion to provide support to the second tubular end portion when the seat is moved to the reclined position;

a third plug spring attached to the seat adjacent the first fastening mechanism to support the first fastening mechanism; and a fourth plug spring attached to the seat adjacent the second fastening mechanism to support the second fastening mechanism; and the first resilient member and the second resilient member sized and configured to resiliently move or flex such that the seat is positioned at the reclined position when a user sits on the seat.

* * * * *